US008323042B2

(12) United States Patent
Lin

(10) Patent No.: US 8,323,042 B2
(45) Date of Patent: Dec. 4, 2012

(54) PROTECTIVE COVER AND REMOVING TOOL THEREFOR

(75) Inventor: Kuan-Lin Lin, Taipei (TW)

(73) Assignee: Center Precision Co., Ltd., New Taipei (TW)

( * ) Notice: Subject to any disclaimer, the term of this patent is extended or adjusted under 35 U.S.C. 154(b) by 0 days.

(21) Appl. No.: 13/170,399

(22) Filed: Jun. 28, 2011

(65) Prior Publication Data

US 2012/0282788 A1 Nov. 8, 2012

(30) Foreign Application Priority Data

May 6, 2011 (TW) ..... 00115944 A

(51) Int. Cl.
*H01R 13/44* (2006.01)

(52) U.S. Cl. ..... 439/135; 439/133; 439/148; 439/304

(58) Field of Classification Search ..... 439/133, 439/134, 135, 148, 304
See application file for complete search history.

(56) References Cited

U.S. PATENT DOCUMENTS 5,340,324 A * 8/1994 Fields et al. ..... 439/133
5,637,002 A * 6/1997 Buck et al. ..... 439/148
7,037,129 B2 * 5/2006 Lo et al. ..... 439/352
7,632,125 B2 * 12/2009 Irwin et al. ..... 439/304
7,862,365 B2 * 1/2011 Morrison et al. ..... 439/344
7,909,625 B2 * 3/2011 Obenshain ..... 439/133
7,993,063 B2 * 8/2011 Hackett ..... 385/58
8,112,879 B2 * 2/2012 Morrison et al. ..... 29/764
8,113,856 B2 * 2/2012 Morrison et al. ..... 439/148
2006/0040564 A1 * 2/2006 Morrison et al. ..... 439/676

* cited by examiner

*Primary Examiner* — James Harvey
(74) *Attorney, Agent, or Firm* — Muncy, Geissler, Olds & Lowe, PLLC

(57) ABSTRACT

A protective cover for locking to a jack module includes a main body for inserting into the jack module and having two openings, and two elastic arms for locking the protective cover to the jack module and having a first engaging unit each. A removing tool for unlocking and removing the protective cover from the jack module includes a handle portion and two arms. The arms respectively include a front cam surface for inserting into the main body to deflect the elastic arms and unlock the protective cover from the jack module, and a second engaging unit formed behind the cam surface for engaging with the first engaging unit, allowing a user to remove the protective cover from the jack module. The protective cover and removing tool respectively integrate the unlocking and removing functions into one structurally simplified device and is more convenient for use.

5 Claims, 11 Drawing Sheets

PROTECTIVE COVER AND REMOVING TOOL THEREFOR

CROSS-REFERENCE TO RELATED APPLICATION

This non-provisional application claims priority under 35 U.S.C. §119(a) on Patent Application No(s). 100115944 filed in Taiwan, R.O.C. on May 6, 2011, the entire contents of which are hereby incorporated by reference.

FIELD OF THE INVENTION

The present invention relates to a protective cover and a removing tool therefor; and more particularly to a protective cover for locking to a jack module and a structurally simplified tool for conveniently unlocking and removing the protective cover from the jack module in one operation.

BACKGROUND OF THE INVENTION

The highly advanced technological fields bring on the quick development of networks. To use different networks, a large quantity of jack modules is provided. In the early stage of setting up networks, the jack modules for accessing to the networks were not provided with any protective covers and were therefore subject to damage by invaded foreign matters or unauthorized connection and use. In view of such problems, protective covers for guarding the jack modules against foreign matters and unauthorized connection have been designed. However, to achieve the protection purpose, most of the conventional protective covers for the jack modules have complicated locking structures and require structurally complicated removing tools to remove the protective covers from the jack modules. Further, since the conventional protective covers and removing tools therefor have complicated structures, they are not convenient for use.

It is therefore tried by the inventor to develop a protective cover for jack module and a removing tool therefor, so that the protective cover can be quickly unlocked and removed from the jack module with the removing tool, which is structurally simplified and integrates the unlocking and the removing functions, allowing a user to conveniently operate the protective cover and the removing tool.

SUMMARY OF THE INVENTION

A primary object of the present invention is to provide a protective cover for a jack module, and a structurally simplified tool for conveniently unlocking and removing the protective cover from the jack module in one operation.

To achieve the above and other objects, a first aspect of the present invention provides a protective cover for locking to a jack module. The protective cover comprises a main body having at least one opening provided thereon and being configured for inserting into the jack module with the opening facing away from the jack module; and at least one elastic arm being obliquely arranged in the main body and having a first engaging unit provided thereon; the elastic arm being normally pressed against an inner wall surface of the jack module to lock the protective cover to the jack module; the elastic arm being deflectable to unlock the protective cover; and the unlocked protective cover being removable from the jack module by engaging the first engaging unit.

According to a second aspect of the present invention, a removing tool for unlocking and removing the above-structured protective cover from the jack module is provided. The removing tool comprises a handle portion; and at least one arm being connected to the handle portion with a rear part of the arm, and having a cam surface and a second engaging unit from front to rear of the arm; whereby when the protective cover being unlocked and removed from the jack module, the cam surface of the arm being used to deflect then unlock the protective cover from the jack module, the second engaging unit of the arm being used to engage then remove the protective cover from the jack module.

The protective cover and removing tool of the present invention respectively integrate the unlocking and the removing functions into one structurally simplified device, allowing the user to use the protective cover and the removing tool in a more convenient manner.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with some preferred embodiments thereof and with reference to the accompanying drawings.

Figure 1:
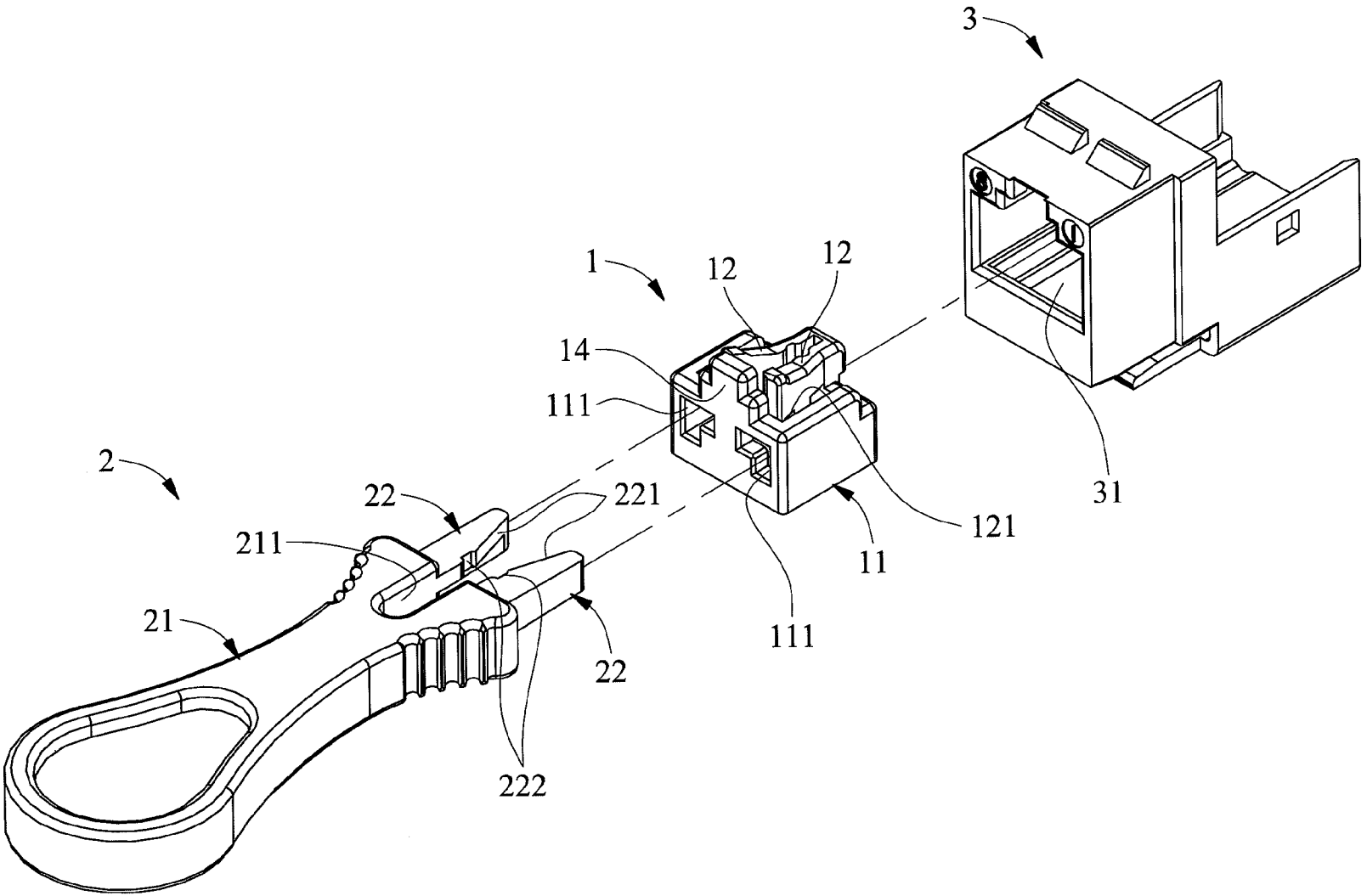
FIG. 1 is an exploded perspective view showing a protective cover and a removing tool therefor according to an embodiment of the present invention, and a jack module for which the protective cover is provided.
Figure 2:
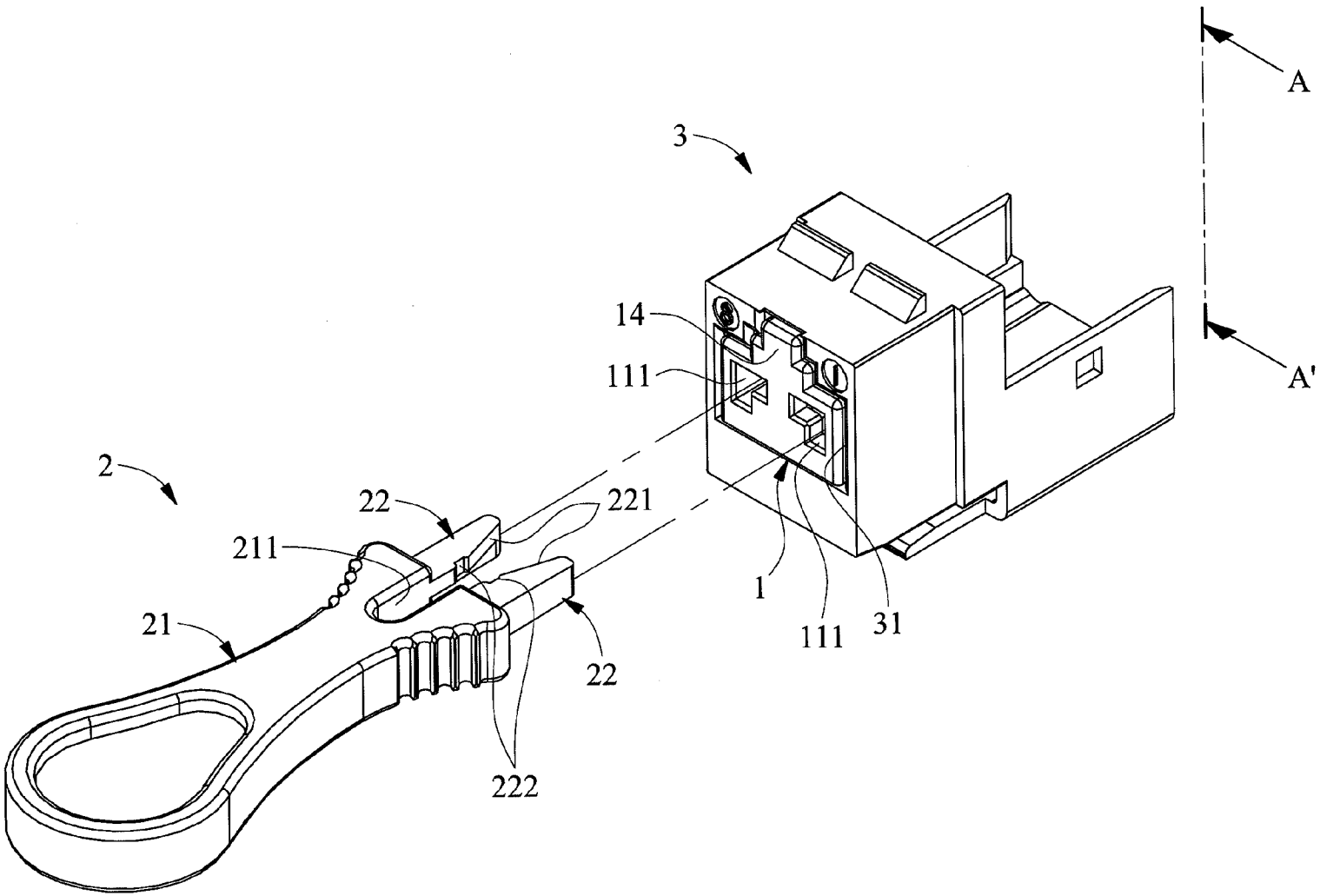
FIG. 2 is a partially assembled perspective view of FIG. 1 with the protective cover locked to the jack module.
Figure 3:
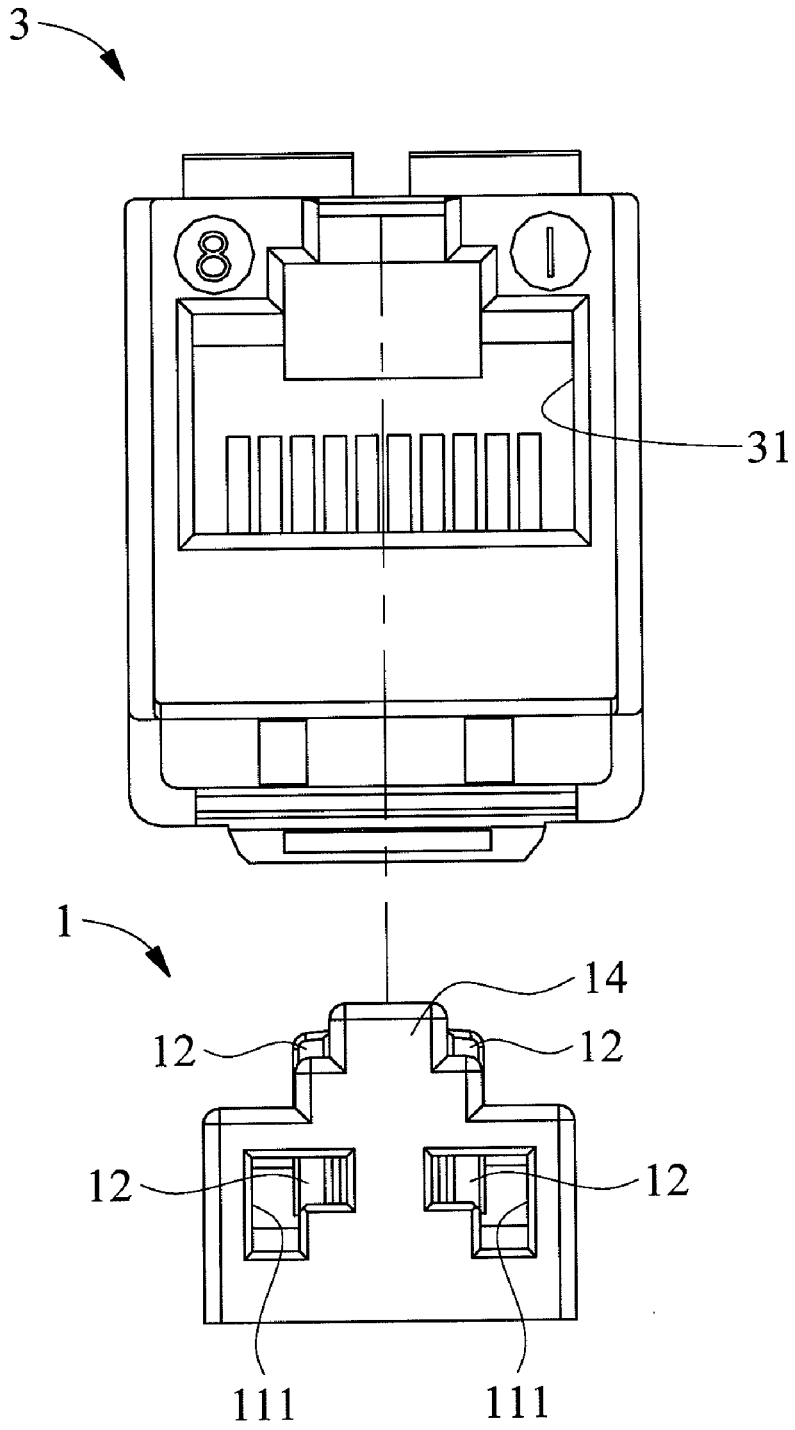
FIG. 3 is a front view showing the protective cover of the present invention and the jack module in a separated state.
Figure 4:
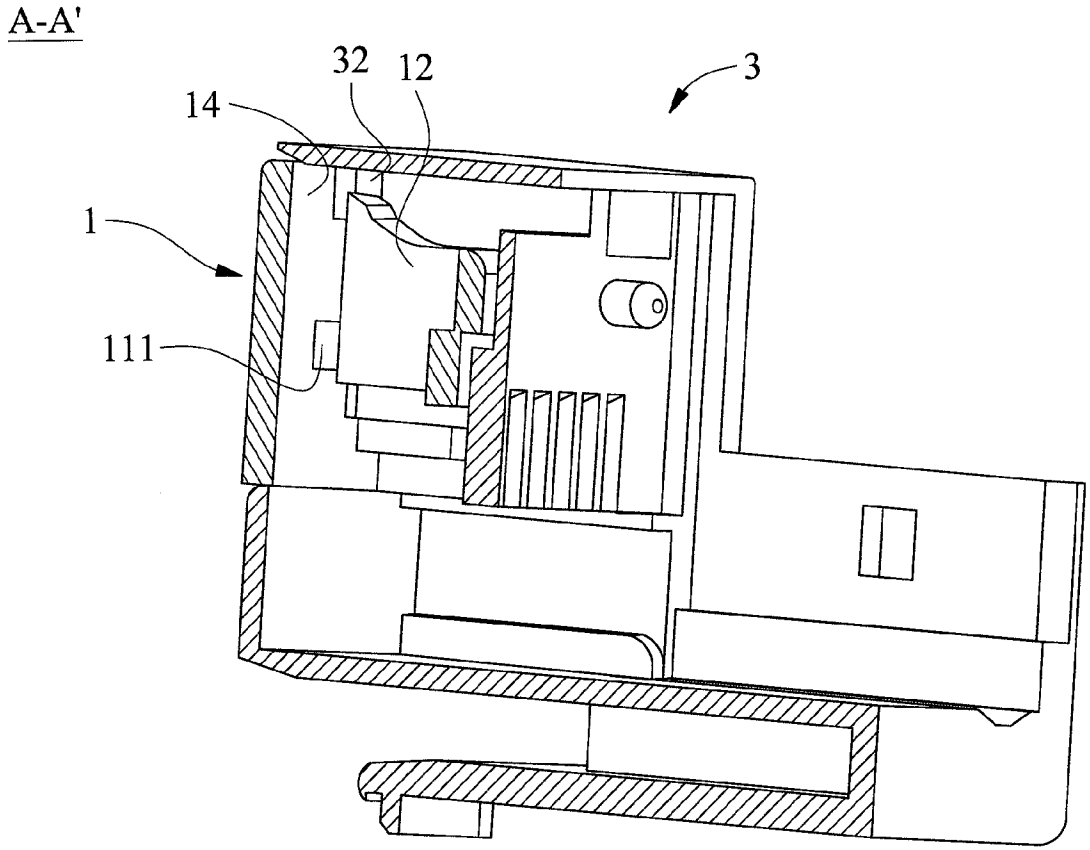
FIG. 4 is a sectional view taken along line A-A' of FIG. 2.
Figure 5:
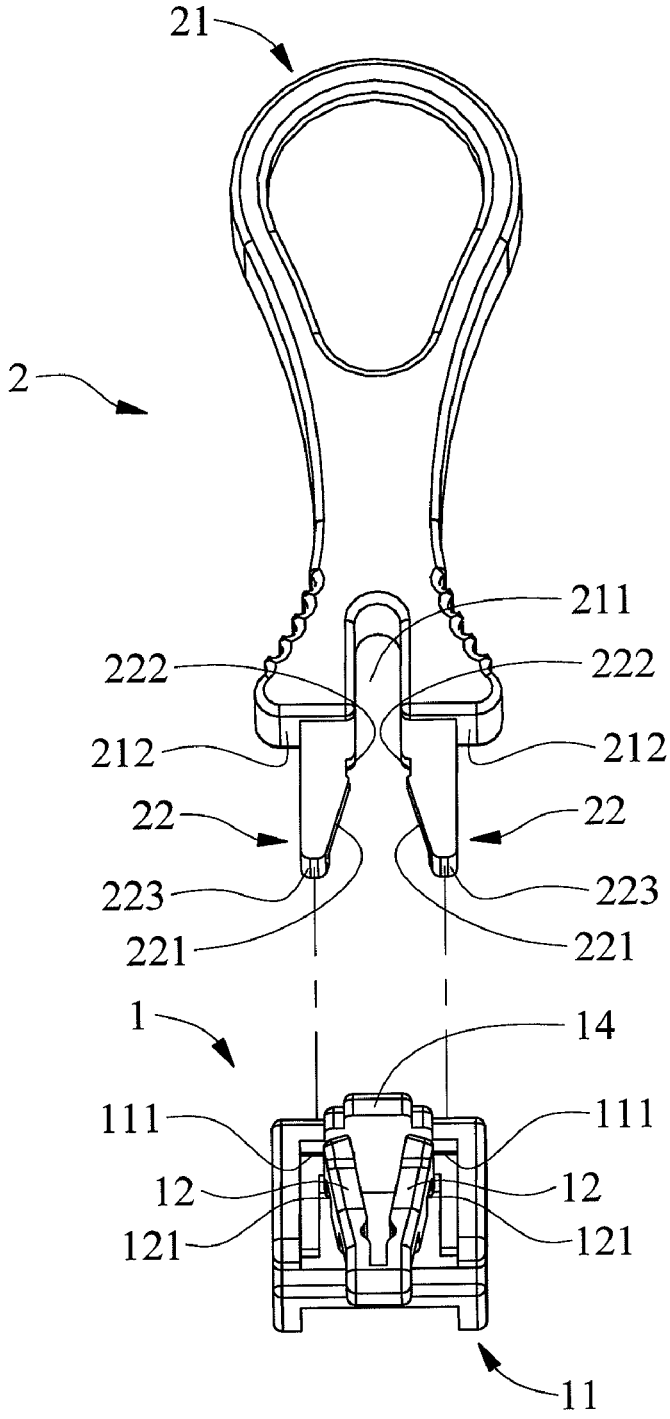
FIG. 5 is a perspective view showing the protective cover and the removing tool according to the present invention.
Figure 6:
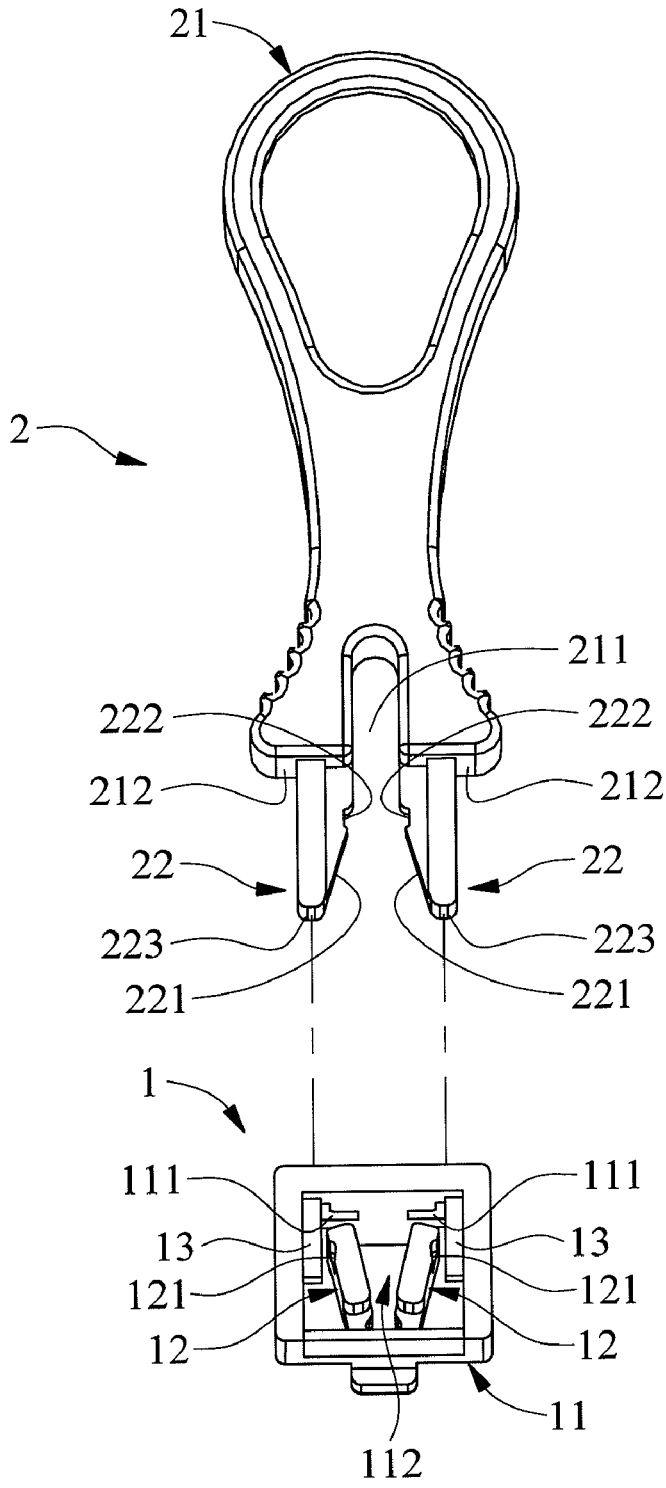
FIG. 6 is another perspective view showing the protective cover and the removing tool according to the present invention.
Figure 7:
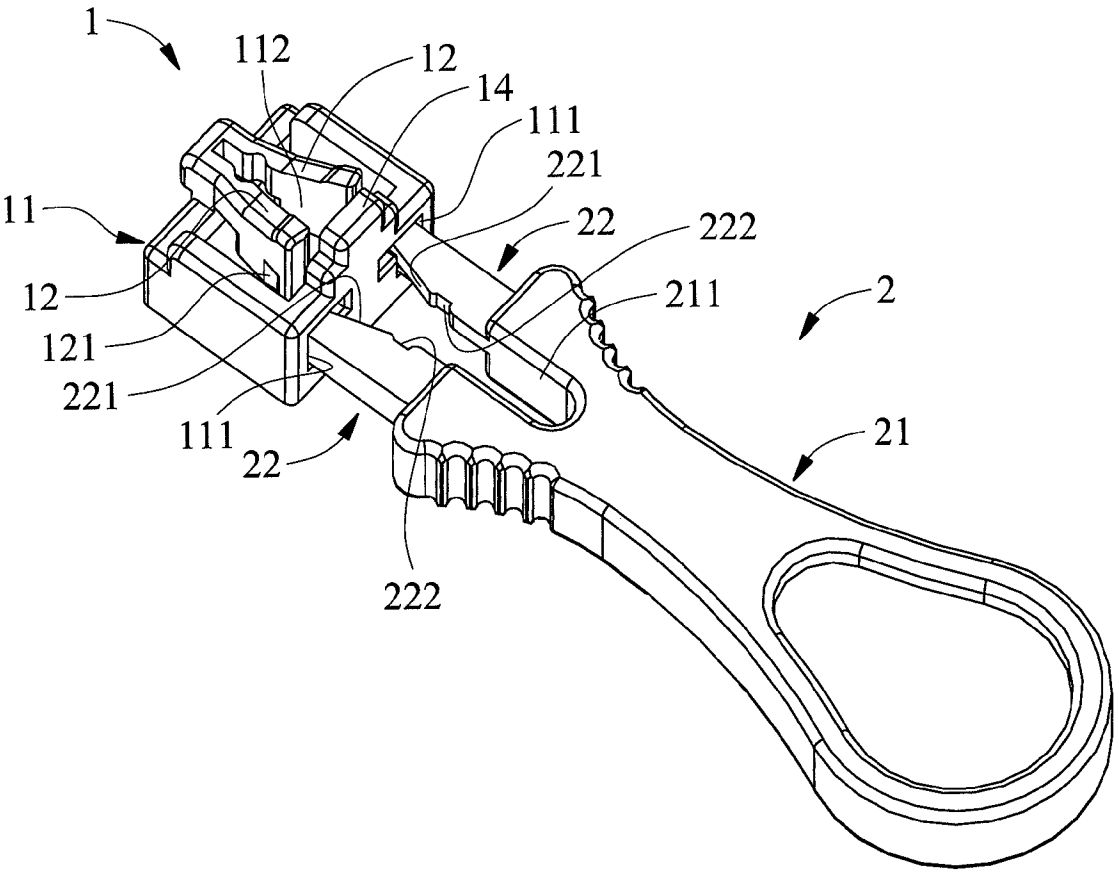
FIGS. 7 to 11 show how the removing tool inserted into the protective cover unlocks and removes the latter from the jack module.
Figure 8:
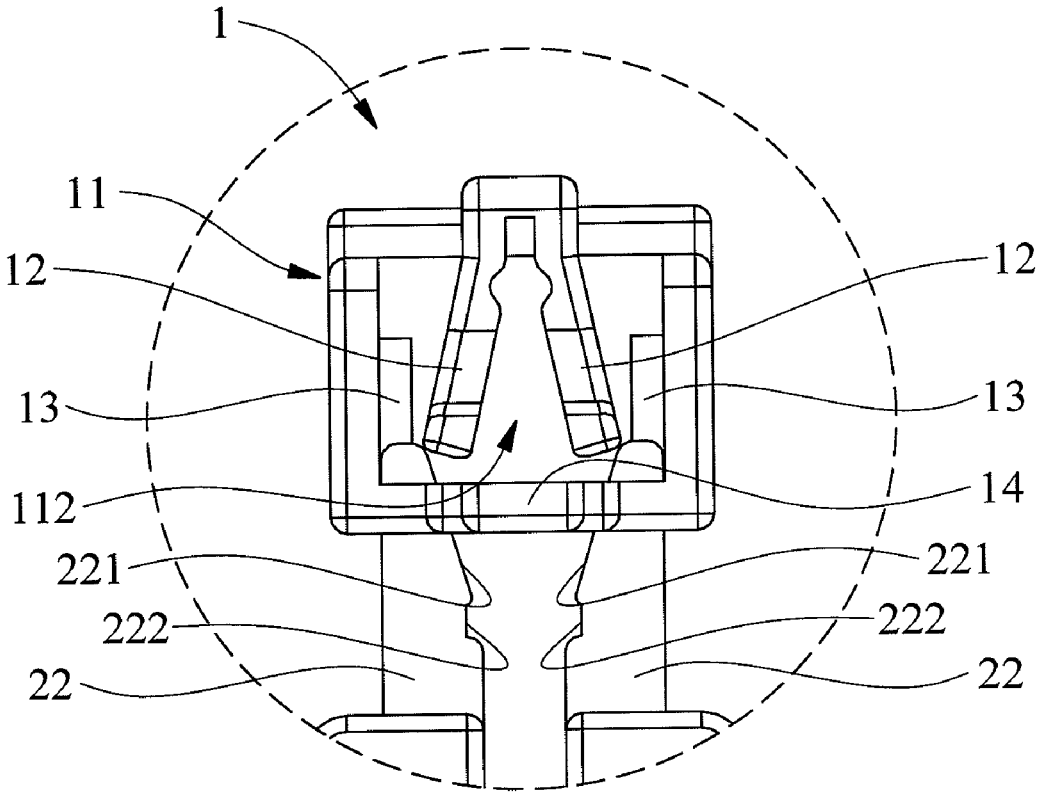
Figure 9:
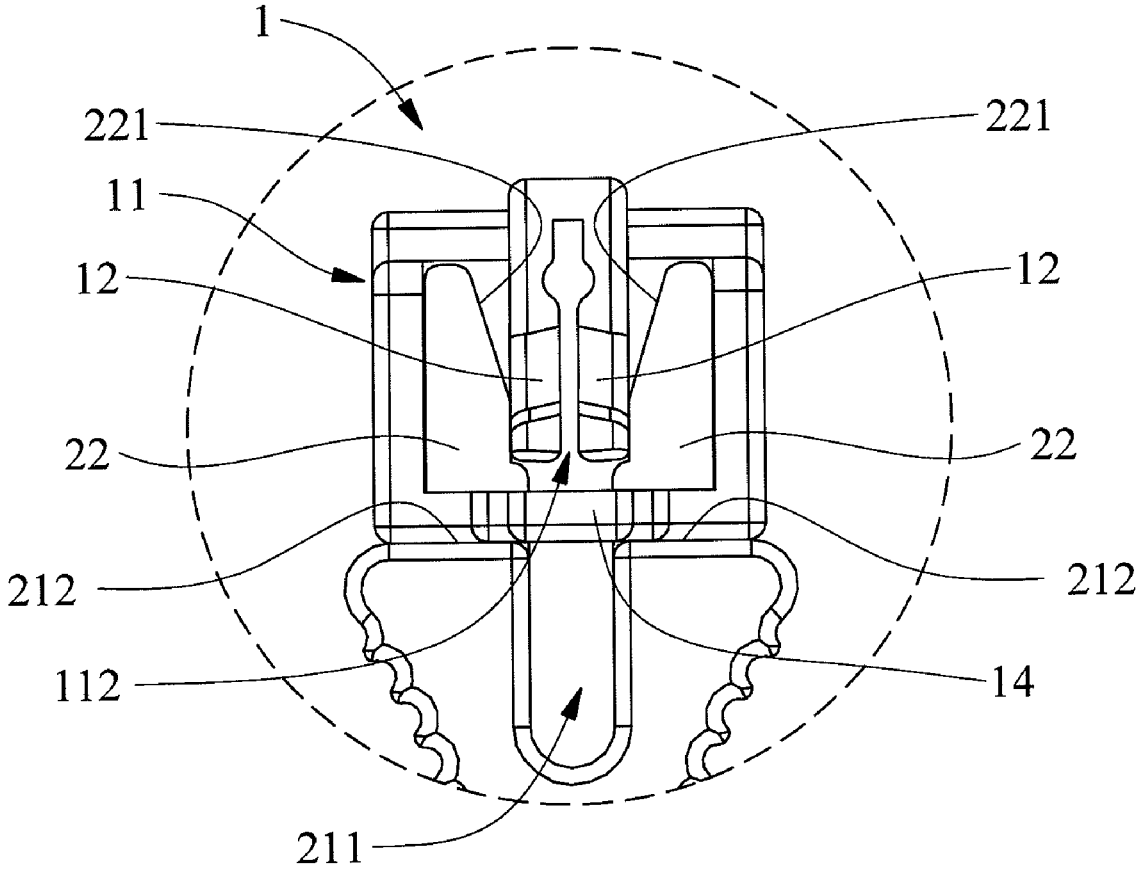

Please refer to FIGS. 1 to 6, in which FIG. 1 is an exploded perspective view showing a protective cover 1 and a removing tool 2 therefor according to an embodiment of the present invention, and a jack module 3 for which the protective cover 1 is provided, FIG. 2 is a partially assembled view of FIG. 1 with the protective cover 1 locked to the jack module, FIG. 3 is a front view showing the protective cover 1 and the jack module 3 in a separated state, FIG. 4 is a sectional view taken along line A-A' of FIG. 2, and FIGS. 5 and 6 are perspective views showing the protective cover 1 and the removing tool 2. As shown, according to a first aspect of the present invention, a protective cover 1 is provided for locking to a jack module 3, and includes a main body 11 and at least one elastic arm 12. The main body 11 has at least one opening 111 provided thereon, and is configured for inserting into the jack module 3 with the opening 111 facing away from the jack module 3. The elastic arm 12 is arranged in the main body 11. In an embodiment of the present invention, the main body 11 internally defines a hollow central zone 112, and the elastic arm 12 is located in the hollow central zone 112 with an end connected to an inner rear part of the main body 11. A first engaging unit 121 is provided on a left or a right side of the elastic arm 12, depending on a location of the elastic arm 12 in the main body 11. When the main body 11 is inserted into the jack module 3, the elastic arm 12 has an upper front end pressed against an inner wall surface 32 of the jack module 3 to thereby lock the whole protective cover 1 to the jack module 3. When the protective cover 1 is unlocked from the jack module 3, the elastic arm 12 can be rightward or leftward deflected to thereby separate its upper front end from the inner wall surface 32 of the jack module 3; and when the first engaging unit 121 is engaged, the protective cover 1 can be removed from the jack module 3 by a force pulls the first engaging unit 121.

Please refer to FIGS. 1 and 4 to 6. In an embodiment of the present invention, the elastic arm 12 is obliquely extended from the inner rear part of the main body 11 toward a front left side thereof, and the first engaging unit 121 is provided on the left side of the elastic arm 12 and located closer to a front end of the elastic arm 12. Meanwhile, the front end of the elastic arm 12 is located behind a right side of the opening 111 for pressing against the inner wall surface of the jack module 3. Alternatively, in another embodiment of the present invention, the elastic arm 12 is obliquely extended from the inner rear part of the main body 11 toward a front right side thereof, and the first engaging unit 121 is provided on the right side of the elastic arm 12. Meanwhile, the front end of the elastic arm 12 is located behind a left side of the opening 111 for pressing against the inner wall surface 32 of the jack module 3.

Please refer to FIGS. 1 to 4 at the same time. The protective cover 1 will now be described with the elastic arm 12 obliquely extended from the inner rear part of the main body 11 toward the front right side of the main body 11. In this embodiment, there are one opening 111 and one elastic arm 12, and the jack module 3 has one socket 31 provided thereon. The socket 31 has a step-shaped upper portion, and the main body 11 is provided at an upper front end with a step-shaped blocking plate 14 corresponding to the step-shaped upper portion of the socket 31. The front end of the elastic arm 12 is normally offset from the blocking plate 14. When the protective cover 1 is inserted into the jack module 3 via the socket 31, the step-shaped upper portion of the socket 31 would press against the obliquely extended elastic arm 12, bringing the elastic arm 12 to deflect leftward and accordingly locate behind the blocking plate 14. When the protective cover 1 is fully inserted into the jack module 3, the step-shaped upper portion of the socket 31 no longer presses against the obliquely extended elastic arm 12, and the elastic arm 12, due to an elastic restoring force thereof, deflects rightward and returns to an original position thereof with its upper front end abutting on a back of the step-shaped upper portion of the socket 31, i.e., the inner wall surface 32 of the jack module 3, bringing the protective cover 1 to lock to the jack module 3. In the locked state, the protective cover 1 could not be arbitrarily removed from the jack module 3 by a pull force directly applied thereto. With the protective cover 3 locked to the jack module 3, the jack module 3 is protected against external foreign matters and any unauthorized connection. On the other hand, in the case the elastic arm 12 is obliquely extended from the inner rear part of the main body 11 toward the front left side of the main body 11, the elastic arm 12 can be actuated in similar manner as described above to lock the protective cover 1 to the jack module 3 to provide the same protection functions.

Please further refer to FIGS. 1 to 4 at the same time. In another embodiment of the present invention, there are two openings 111 and two elastic arms 12 provided on the protective cover 1. The two elastic arms 12 are obliquely extended from the inner rear part of the main body 11 toward the front left and the front right side of the main body 11, respectively. The two elastic arms 12 are actuated in similar manner as described above to lock the protective cover 1 to the jack module 3 to provide the same protection functions. In the embodiment having two openings 111 and two elastic arms 12, the two elastic arms are laterally symmetrically arranged to abut against the back of the step-shaped upper portion of the socket 31, i.e., the inner wall surface 32 of the jack module 3, to uniformly bear the pull force applied to the protective cover 1, enabling the protective cover 1 to be more securely locked to the jack module 3.

Please refer to FIGS. 1 to 3 at the same time. The openings 111 are L-shaped, allowing the removing tool 2 to be inserted into the openings 111 only in a specific direction to unlock the protective cover 1 from the jack module 3. This design prevents a user from inserting the removing tool 2 into the openings 111 in a wrong direction, making the protective cover 1 more convenient for use.

Please refer to FIGS. 5 and 6. The first engaging unit 121 may be hook-shaped for engaging with the removing tool 2 when the latter is fully inserted into the protective cover 1, so that the protective cover 1 can be unlocked from and pulled out of the jack module 3 using the removing tool 2.

Please refer to FIG. 6. In the case the elastic arm 12 is obliquely extended from the inner rear part of the main body 11 toward the front left side of the main body 11, an front-rear directional extended first guiding flange 13 is provided on an inner left wall surface of the main body 11. Alternatively, in the case the elastic arm 12 is obliquely extended from the inner rear part of the main body 11 toward the front right side of the main body 11, the first guiding flange 13 is provided on an inner right wall surface of the main body 11. In either case, when the removing tool 2 is inserted into the opening 111, the first guiding flange 13 guides the removing tool 2 to move forward into the main body 11 without deviation, so that the removing tool 2 can be conveniently operated.

As having been mentioned above, FIG. 1 is an exploded perspective view showing a protective cover 1 and a removing tool 2 according to an embodiment of the present invention, and a jack module 3 for which the protective cover 1 is provided; FIG. 2 is a partially assembled view of FIG. 1 with the protective cover 1 locked to the jack module; and FIGS. 5 and 6 are perspective views showing the protective cover 1 and the removing tool 2. As shown, according to a second aspect of the present invention, a removing tool 2 is provided for unlocking and removing the protective cover 1 from the jack module 3. The removing tool 2 includes a handle portion 21 and at least one arm 22. The arm 22 is connected to the handle portion 21 with a rear part of the arm 22 and is provided with a cam surface 221 and a second engaging unit 222 from front to rear of the arm 22. When the protective cover 1 being unlocked and removed from the jack module 3, the cam surface 221 of the arm 22 being used to deflect then unlock the protective cover 1 from the jack module 3, the second engaging unit 222 of the arm 22 being used to engage then remove the protective cover 1 from the jack module 3.

FIGS. 7 to 11 show how the removing tool 2 inserted into the protective cover 1 unlocks and removes the latter from the jack module 3. Please refer to FIGS. 7 to 11 along with FIGS. 3 and 4. In an embodiment of the present invention having one opening 111, one elastic arm 12 and one arm 22, when a user holds the handle portion 21 of the removing tool 2 to insert the arm 22 into the opening 111 on the protective cover 1, a lateral outer side of the arm 22 is bearing on an inner wall surface of the main body 11 of the protective cover 1, such that the cam surface 221 of the arm 22 is pressed on a front end of the elastic arm 12, as can be most clearly seen in FIG. 8. When the arm 22 is gradually inserted deeper into the opening 111, the elastic arm 12 is deflected by the cam surface 221 of the arm 22 to finally move away from the back of the step-shaped upper portion of the socket 31 of the jack module 3 (i.e. the inner wall surface 32 of the jack module 3) into a location behind the blocking plate 14, so that the protective cover 1 is unlocked from the jack module 3. At this point, the second engaging unit 222 on the removing tool 2 also engages with the first engaging unit 121 of the elastic arm 12, allowing the user to apply a pulling force on the handle portion 21 of the removing tool 2, so as to remove the protective cover 1 from the jack module 3 via the removing tool 2.

Please refer to FIG. 1 again. In an embodiment of the present invention having two openings 111, two elastic arms 12 and two arms 22, the two arms 22 are spaced from each other with the cam surface 221 and second engaging unit 222 on one of the arms 12 correspondingly facing toward the cam surface 221 and second engaging unit 222 on the other arm 12. The two arms 22 work in similar manner as described above to deflect the elastic arms 12 and provide the same functions of unlocking and removing the protective cover 1 from the jack module 3.

The handle portion 21 of the removing tool 2 can be provided with a recess 211, which is located between the two arms 22 to allow some degree of deflection for the handle portion 21, so that the two arms 22 can be slightly moved toward or away from each other to compensate some possible size error between the two openings 111.

Figure 10:
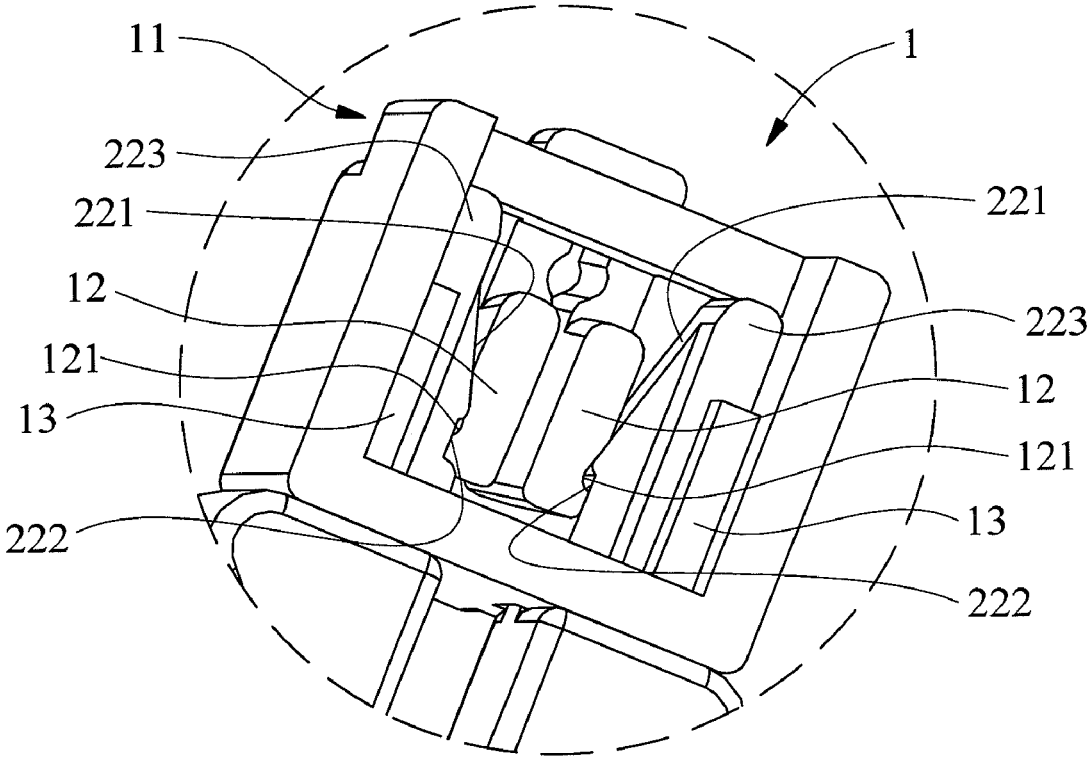
Figure 11:
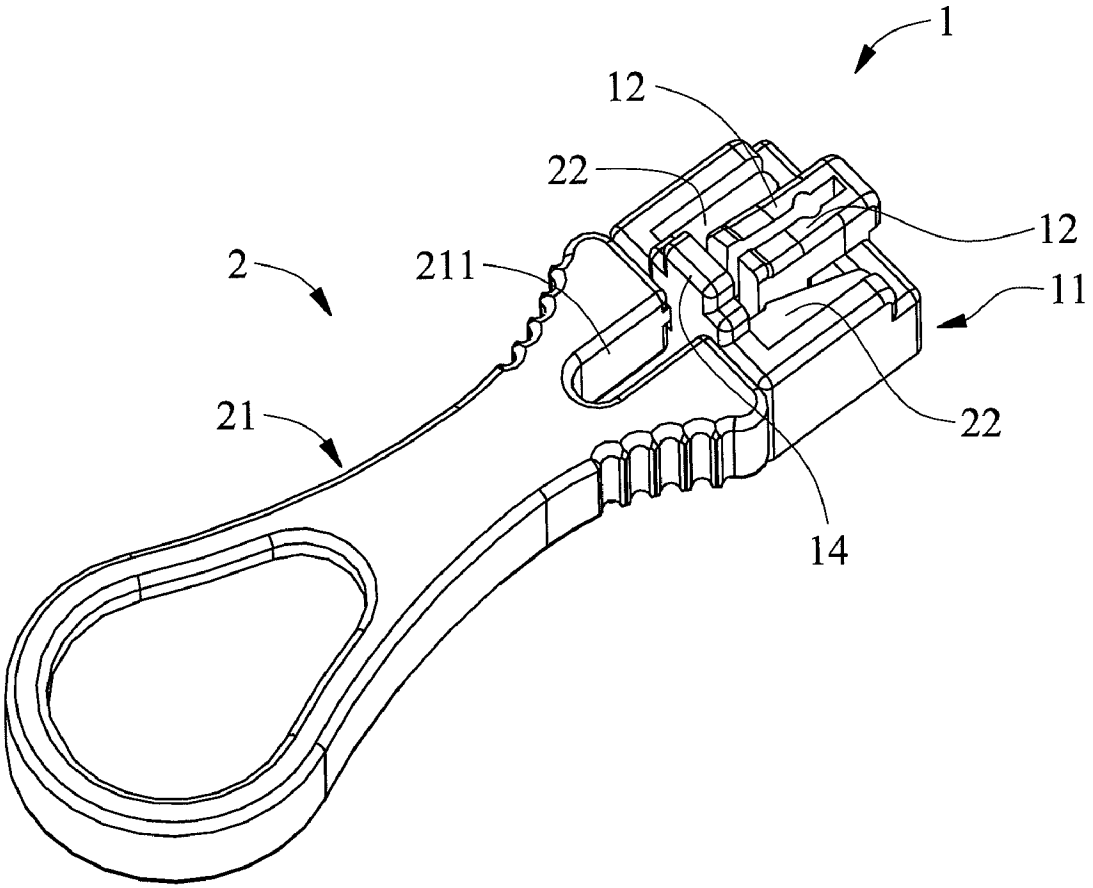

As can be seen from FIGS. 6 and 10, each of the arms 22 is provided along an outer lateral side with a front-rear directional extended second guiding flange 223, such that the arms 22 respectively have an L-shaped cross section. With the second guiding flanges 223, the removing tool 2 can be inserted into the openings 111 only in a specific direction to unlock the protective cover 1 from the jack module 3. This design prevents a user from inserting the removing tool 2 into the openings 111 in a wrong direction, making the protective cover 1 and the removing tool 2 more convenient for use.

Further, as can be seen in FIG. 10, the second engaging unit 222 can be hook-shaped for engaging with the hook-shaped first engaging unit 121. With the second engaging unit 222 engaged with the first engaging unit 121, a user may easily remove the unlocked protective cover 1 from the jack module 3 simply by pulling the removing tool 2 outwardly.

As can be seen in FIG. 5, a stop surface 212 is provided on the removing tool 2 at a joint of the handle portion 21 and each of the arms 22. When the arms 22 of the removing tool 2 are fully inserted into the openings 111, the stop surfaces 212 are pressed against a front face of the protective cover 1 to stop the arms 22 from moving further into the protective cover 1 and accordingly ensure exact engagement of the second engaging unit 222 with the first engaging unit 121, making the protective cover 1 and the removing tool 2 more convenient for use.

Please refer back to FIG. 1. The handle portion 21 can be configured to have a front section, a width-reduced middle section and a width-expanded rear section. The user may grip the removing tool 2 at the width-reduced middle section of the handle portion 21 with his or her hand rearwardly resting on the width-expanded rear section of the handle portion 21, so as to more easily apply a pulling force on the removing tool 2 to remove the unlocked protective cover 1 from the jack module 3.

The present invention is novel and improved because the protective cover 1 includes at least one elastic arm 12 having a first engaging unit 121, and the removing tool 2 includes at least one arm 22 having a cam surface 221 for deflecting the elastic arm to unlock the protective cover 1 from the jack module 3 and a second engaging unit 222 for engaging with the first engaging unit 121 of the protective cover 1, so that the unlocked protective cover 1 can be easily removed from the jack module 3 simply by pulling the removing tool 2 outward. That is, the removing tool 2 of the present invention integrates unlocking and removing functions into one structurally simplified device to provide high convenience in operation. The present invention is also industrially valuable because products derived from the present invention would no doubt fulfill the current market demands.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A protective cover for locking to a jack module, comprising:

a main body having at least one opening provided thereon and being configured for inserting into the jack module with the opening facing away from the jack module; and at least one elastic arm being obliquely arranged in the main body and having a first engaging unit provided thereon; the elastic arm being normally pressed against an inner wall surface of the jack module to lock the protective cover to the jack module; the elastic arm being deflectable to unlock the protective cover; and the unlocked protective cover being removable from the jack module by engaging the first engaging unit, wherein, when the elastic arm is obliquely extended from an inner rear part of the main body toward a front left side of the main body, the first engaging unit is provided on a left side of the elastic arm, and a front end of the elastic arm is located behind a right side of the opening to press against the inner wall surface of the jack module; and wherein, when the elastic arm is obliquely extended from an inner rear part of the main body toward a front right side of the main body, the first engaging unit is provided on a right side of the elastic arm, and a front end of the elastic arm is located behind a left side of the opening to press against the inner wall surface of the jack module.

2. The protective cover as claimed in claim 1, a front-rear directional first guiding flange being provided on an inner left wall surface of the main body when the elastic arm is obliquely extended from an inner rear part of the main body toward a front left side of the main body; and a front-rear directional first guiding flange being provided on an inner right wall surface of the main body when the elastic arm is obliquely extended from the inner rear part of the main body toward a front right side of the main body.

3. The protective cover as claimed in claim 1, wherein the main body has two openings provided thereon and the protective cover includes two elastic arms; and the two elastic arms being obliquely extended from the inner rear part of the main body toward a front left and a front right side of the main body, respectively.

4. The protective cover as claimed in claim 1, wherein the opening is L-shaped.

5. The protective cover as claimed in claim 1, wherein the first engaging unit is hook-shaped.

* * * * *